US006141995A

United States Patent [19]

Johnson

[11] Patent Number: 6,141,995

[45] Date of Patent: Nov. 7, 2000

[54] METHOD AND APPARATUS FOR MOUNTING A PUMP TO A WASHING MACHINE

[75] Inventor: Troy Johnson, Newton, Iowa

[73] Assignee: Maytag Corporation, Newton, Iowa

[21] Appl. No.: 08/997,646

[22] Filed: Dec. 23, 1997

[51] Int. Cl.[7] ..... D06F 39/08

[52] U.S. Cl. ..... 68/3 R; 68/184; 417/361; 134/201; 134/188

[58] Field of Search ..... 68/3 R, 184; 417/360, 417/361, 423.15; 134/188; 248/222.52, 222.41, 673; 403/348, 349; 415/912; 15/412

[56] References Cited

U.S. PATENT DOCUMENTS

| | | | |
|---|---|---|---|
| 1,669,538 | 5/1928 | Schmidt | 134/188 |
| 2,251,564 | 8/1941 | Conterman | 68/3 R |
| 2,880,740 | 4/1959 | Prglow | 134/188 |
| 2,946,286 | 7/1960 | Sholtes et al. | 68/184 |
| 3,583,835 | 6/1971 | Coburn Sr. | 134/188 |
| 3,853,429 | 12/1974 | Wiedenmann . | |
| 4,306,841 | 12/1981 | Morrison et al. | 68/184 |
| 4,467,627 | 8/1984 | Platt et al. . | |
| 4,757,786 | 7/1988 | Ellegard . | |
| 4,784,046 | 11/1988 | Gautier . | |
| 5,021,048 | 6/1991 | Buckholtz . | |
| 5,044,883 | 9/1991 | Neueder . | |
| 5,117,656 | 6/1992 | Keck et al. . | |
| 5,118,254 | 6/1992 | Ellingson et al. . | |
| 5,228,842 | 7/1993 | Guebeli et al. . | |
| 5,624,167 | 4/1997 | Katz . | |
| 5,688,030 | 11/1997 | McAnally et al. . | |
| 5,834,869 | 11/1998 | Morgan et al. . | |

FOREIGN PATENT DOCUMENTS

| | | |
|---|---|---|
| 23 56 041 | 2/1975 | Germany . |
| 4040716 | 6/1992 | Germany . |
| 4404716 | 6/1992 | Germany . |
| 44 44 784 | 6/1995 | Germany . |
| 197 18 027 | 11/1998 | Germany . |
| 59-57698 | 4/1984 | Japan . |
| 2-203898 | 8/1990 | Japan . |
| 2 047 806 | 12/1980 | United Kingdom . |

OTHER PUBLICATIONS

Euorpean Patent Application 260,501, Aug. 1987.
European Patent Application 434,126, Jun. 1991.
European Patent application 777, 369, Nov. 1996.

*Primary Examiner*—Frankie L. Stinson
*Attorney, Agent, or Firm*—Zarley, McKee, Thomte, Voorhees & Sease

[57] ABSTRACT

A pump mount of the present invention is adapted to removably mount a pump to a washing machine without requiring access to the bottom of the washing machine. The pump includes a mount having a pair of feet which are adapted to be secured to the base of the washing machine using a twist lock. The feet can be inserted into holes formed in the washing machine base and the pump twisted to lock the pump in place. The wash tub outlet hose and drain hose are then attached to the pump. The hoses attached to the pump secure the pump in the locked position preventing the pump from twisting to the unlocked position.

9 Claims, 4 Drawing Sheets

METHOD AND APPARATUS FOR MOUNTING A PUMP TO A WASHING MACHINE

BACKGROUND OF THE INVENTION

1. Field Of The Invention

The present invention relates to washing machines. More particularly, though not exclusively, the present invention relates to a method and apparatus for mounting a pump to a washing machine.

2. Problems In The Art

In a typical washing machine, the washing machine pump is one of the areas requiring service compared to other areas. As a result service technicians must remove and replace washing machine pumps regularly.

In a traditional prior art washing machine, the pump is fastened to the base frame of the washing machine with screws or similar fasteners. Therefore, in order to install or remove a pump from a washing machine, the washing machine has to be tipped so that access to the screws or fasteners from underneath of the washing machine base is gained.

Another problem with prior art washing machines is that the pump will vibrate and cause noise. As a result, the pump must be dampened by some means.

FEATURES OF THE INVENTION

A general feature of the present invention is the provision of a method and apparatus for mounting a pump to a washing machine which overcomes problems found in the prior art.

A further feature of the present invention is the provision of a method and apparatus for mounting a pump to a washing machine which uses a twist lock which is held in place by the hoses of the washing machine.

Further features, objects, and advantages of the present invention include:

A method and apparatus for mounting a pump to a washing machine which includes a pair of mounting feet coupled to the pump adapted to lock into the base of the washing machine.

A method and apparatus for mounting a pump to a washing machine which includes a pair of holes and grooves formed in the base of the washing machine to accommodate a twist lock configuration with the pump.

A method and apparatus for mounting a pump to a washing machine which includes a mounting base coupled to the pump which allows the pump to flex.

A method and apparatus for mounting a pump to a washing machine which uses a flexible mount which matches the natural frequency of the mount with the operating frequency of the pump.

A method and apparatus for mounting a pump to a washing machine which uses a flexible mounting member which reduces the strength necessary to pass shipping and installation impacts.

A method and apparatus that allows the pump mounting to remain flexible yet limits the motion of the pump to prevent breaking of the mount during installation and shipping.

A method and apparatus for mounting a pump to a washing machine which allows a user to gain access to the pump from the front of the washing machine.

A method and apparatus for mounting a pump to various locations on a washing machine including the outer tub.

These as well as other features, objects, and advantages of the present invention will become apparent from the following specification and claims.

SUMMARY OF THE INVENTION

The method and apparatus for mounting a component to a washing machine allows the component to be secured using a twist-type fastener to removably secure the component to the appliance. The invention includes a twist lock and one or more hoses coupled to the component and the appliance to secure the component in the locked position. In the preferred embodiment, a washing machine pump is secured to a washing machine by inserting a pair of feet formed on the pump into a corresponding pair of apertures in the base which secure the pump to the base of the appliance after the pump is twisted to a locked position. One or more hoses are then attached to the pump to secure the pump in place.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
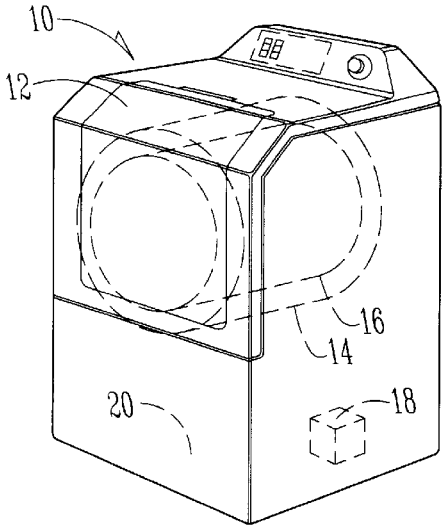
FIG. 1 is a perspective view of a washing machine of the present invention.

FIG. 1 is a perspective view of a washing machine 10 of the present invention. The washing machine 10 shown in FIG. 1 is a horizontal axis washing machine. As shown, the washing machine 10 includes a door 12 which provides access to the interior of the washing machine 10 from the front. Disposed within the washing machine 10 is a wash tub 14 which surrounds a perforated wash basket 16. The components of the washing machine 10 described above are not a part of the present invention. FIG. 1 also shows a pump 18 mounted to the base 20 of the washing machine 10. The pump 18 shown in FIG. 1 is shown diagramatically in order to show its position relative to the remainder of the washing machine 10. The pump 18 is connected to the tub 14 via a tub outlet hose and to a drain via a drain hose. Of course, the pump 18 could be located elsewhere. In addition, the present invention could apply to other types of washing machines and other types of appliances.

Figure 2:
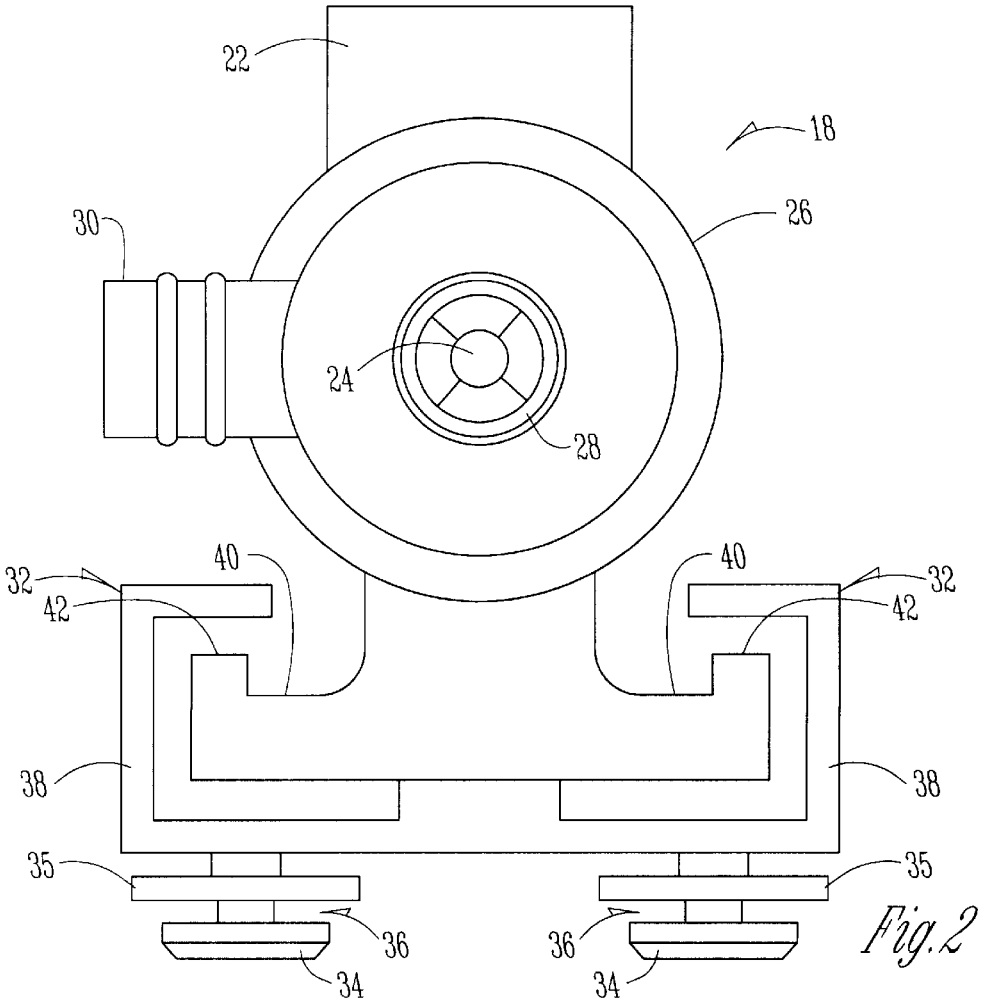
FIG. 2 is a side view of a pump used with the present invention.
Figure 3:
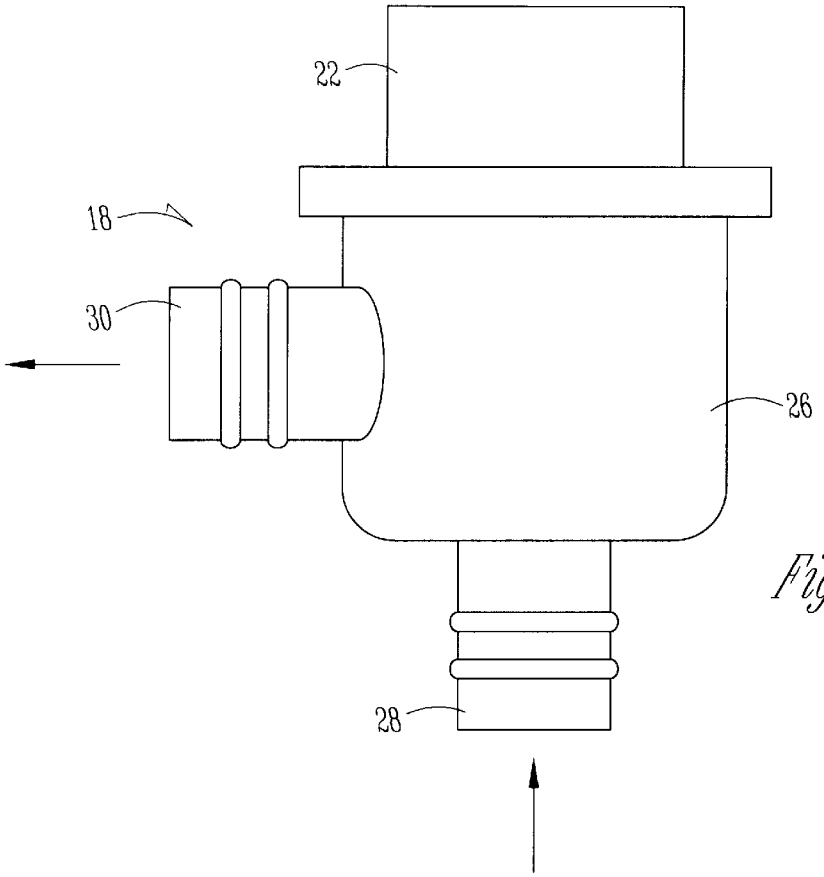
FIG. 3 is a top view of the pump shown in FIG. 2.

FIGS. 2 and 3 show side and top views, respectively, of the washing machine pump 18. The pump 18 is comprised of a motor 22 which is operatively connected to an impeller 24. The impeller 24 is housed within the pump housing 26.

When the motor 22 is activated, water is pumped from an input port 28, through the pump housing 26, and out through the output port 30. In this way, water is drawn out of the wash tub 14, through the pump 18, and is drained via the output port 30.

The pump 18 also includes a pump mount 32. The pump mount 32 further comprises a pair of mounting feet 34 which each include a flange 35 and a slot 36 formed between the feet 34 and the flange 35. The mounting feet 34 are each coupled to an arm 38 which extends outward from the mount 32. The arms 38 are generally C-shaped as shown in FIG. 2. Also extending from the pump mount 32 are a pair of secondary arms 40 which each include a stop 42 which is comprised of an upward facing protrusion. The purpose of the arms 38 and 40 are discussed below. Preferably, the pump mount 32 is made of resilient material such as plastic so that the arms 38 will be flexible.

Figure 4:
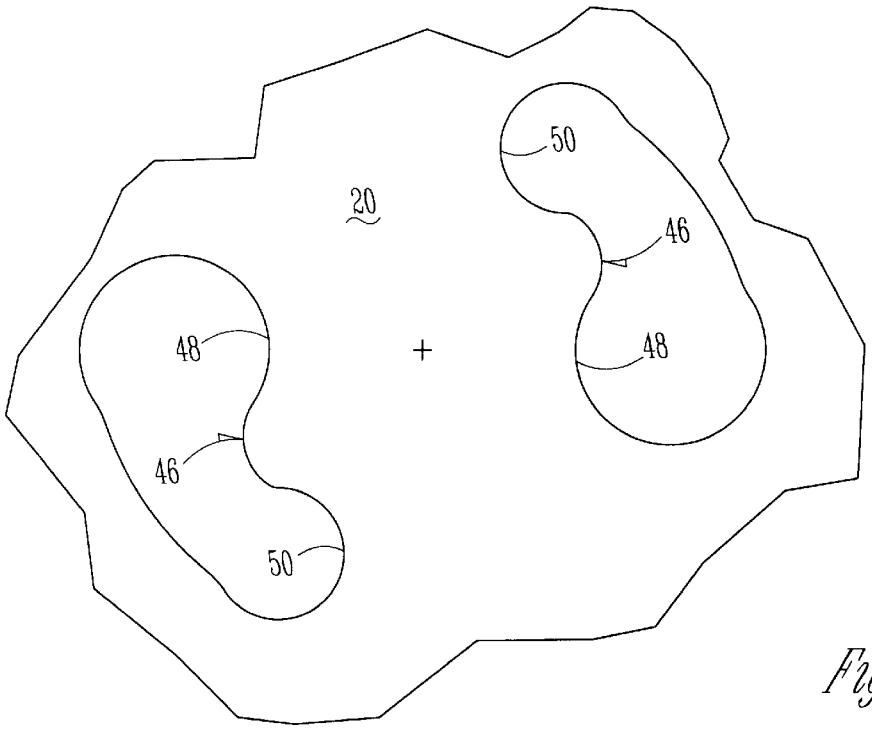
FIG. 4 is a partial plan view of the base of the washing machine shown in FIG. 1.

FIG. 4 is a top view of a portion of the base 20 of the washing machine 10. The base 20 is preferably comprised of sheet metal being approximately 0.045 inches thick. Formed in the base 20 are two mounting apertures 46 which are positioned at the location in which the pump 18 is mounted. The apertures 46 each include a first end 48 having a first diameter and a second end 50 having a second diameter. The first diameter is larger than the diameter of the feet 34, but smaller than the diameter of the flanges 35. The second diameters are smaller than the diameters of both the feet 34 and flanges 35. In this way, the pump 18 can be positioned over the holes 46 such that the feet 34 extend through the first end 48 of the holes 46 such that the feet 34 extend below the base 20, while the flanges 35 rest upon the top of the base 20. Once the pump 18 is set into place as described above, it can be rotated counterclockwise until the feet 34 line up with the second ends 50 of the holes 46. In this position, the pump 18 cannot be lifted from the base 20 without rotating the pump 18 clockwise to where the feet 34 are lined up with the first ends 48 of the holes 46.

Figure 5:
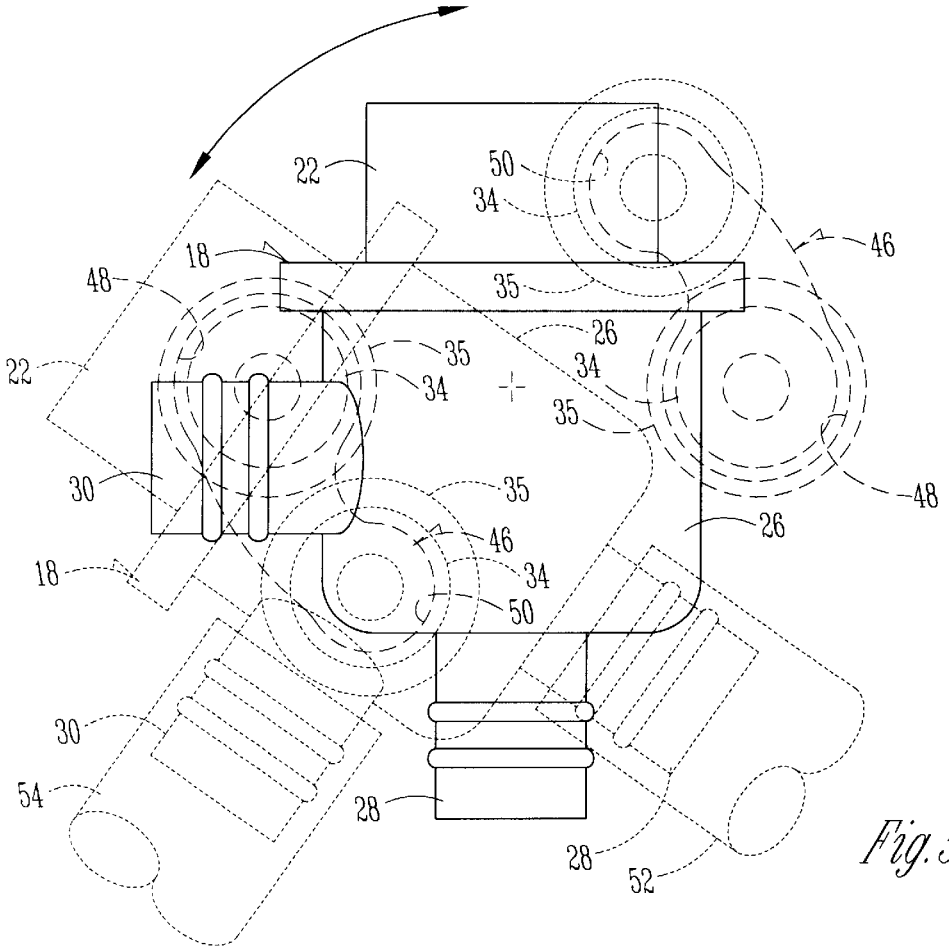
FIG. 5 is a top view of the pump shown in FIGS. 2 and 3 in the locked (dashed lines) and unlocked (solid lines) positions.

FIG. 5 is a top view of the pump 18 and the base 20 of the washing machine 10. FIG. 5 shows the pump 18 in a first position (solid lines) in which the feet 34 are aligned with the first ends 48 of the holes 46. FIG. 5 also shows the pump 18 rotated counterclockwise (dashed lines) showing the feet 34 aligned with the second ends 50 of the holes 46. When the pump 18 is in the position shown by dashed lines, it cannot be removed from the base 20 without rotating the pump 18 clockwise to the position shown by solid lines. Once the pump 18 is rotated counterclockwise to the position shown by dashed lines, the wash tub outlet hose 52 is connected to the input port 28 and the drain hose 54 is connected to the output port 30 as shown. The hoses 52 and 54 hold the pump 18 in the locked position so that the pump 18 cannot rotate clockwise to the position shown in solid lines. In this way, the hoses 52 and 54 lock the pump 18 in place eliminating the need for a detent or screw or some other device for preventing rotation of the pump 18. The hoses 52 and 54 are carefully positioned and selected so that they serve this function. In addition, the hoses 52 and 54 are installed with the proper amount (or lack of) slack in order to inhibit the rotation of the pump 18.

Figure 6:
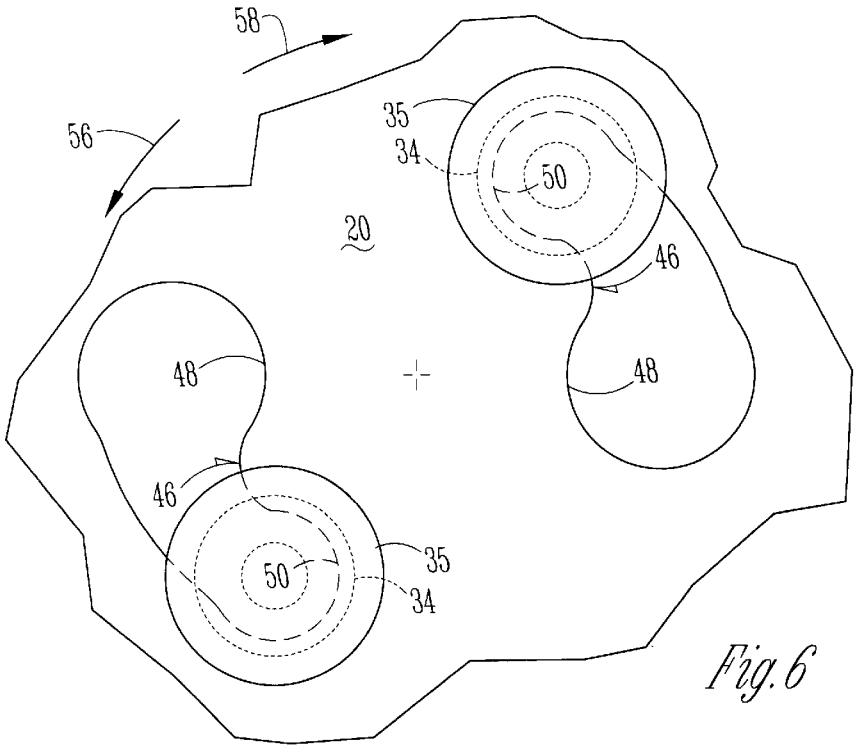
FIG. 6 is a bottom view of the base of the washing machine showing the pump in the locked position.

FIG. 6 is a view taken from below the base 20 showing the mounting apertures 46 and the feet 34 of the pump mount 32. For purposes of clarity, only the feet 34 of the pump 18 are shown in FIG. 6. FIG. 6 also shows arrows 56 and 58. Arrow 56 shows the direction of rotation for removing or unsecuring the pump 18 while arrow 58 shows the direction of rotation for locking the pump 18 into place.

Figure 7:
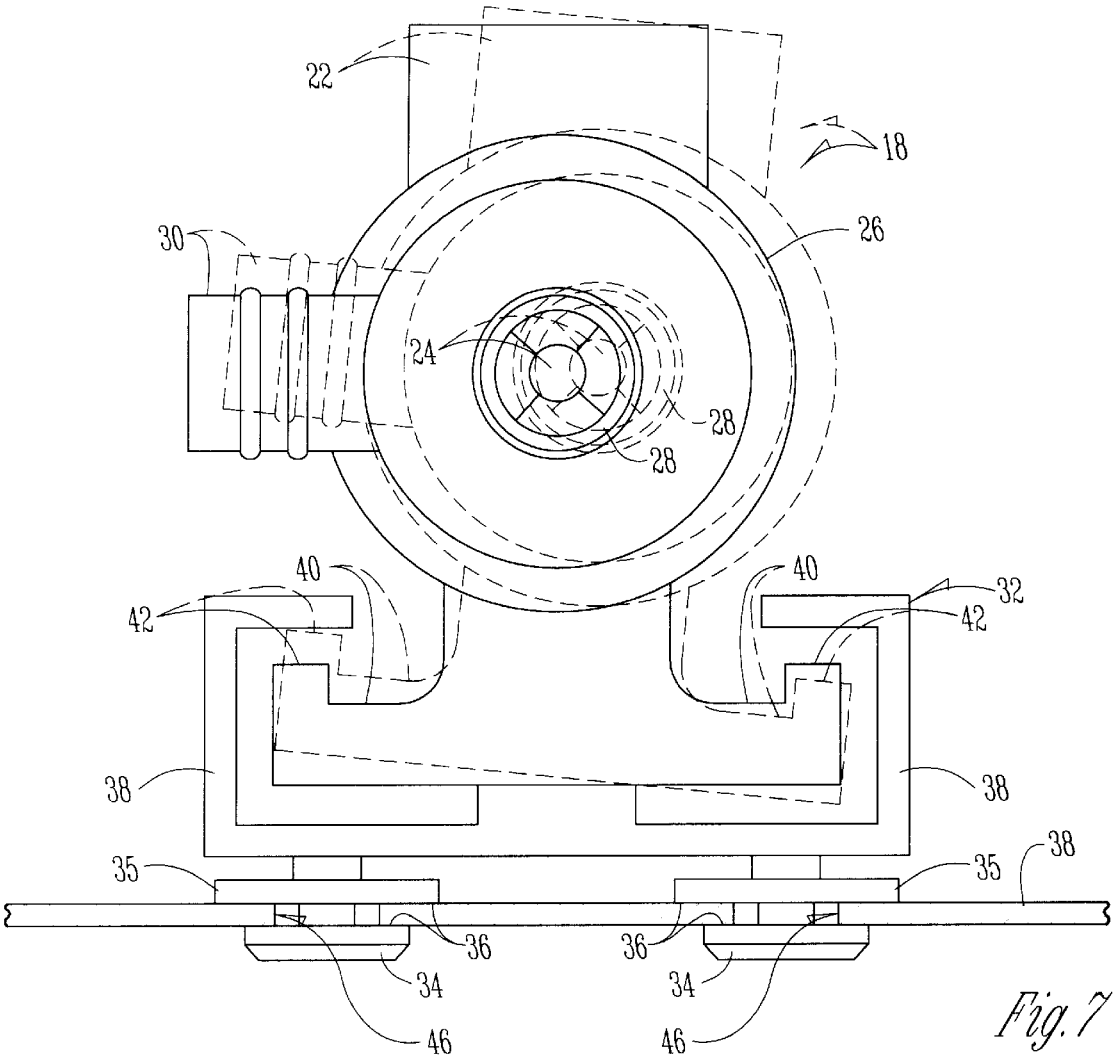
FIG. 7 is a side view of the pump of the present invention illustrating the flexible mount.

FIG. 7 is a side view of the pump 18 shown mounted to the base 20. As mentioned above, the arms 38 are made flexible in order to isolate the pump vibration from the rest of the machine. In addition, while making the mount flexible, it is possible to make the natural frequency of the pump mount 32 match the operating frequency of the pump. If this is done properly, the pump mass will act as part of a tuned mass vibration absorber which will contribute additional vibration isolation from the base 20. One skilled in the art can design the mount in this way simply by carefully selecting the dimensions and configuration of the mount while taking account of such variables as the mass of the pump, the operating speed of the pump, the angular momentum of the pump, etc.

FIG. 7 also illustrates the operation of the flexible pump mount 32. FIG. 7 shows the normal position of the pump 18 in solid lines. In broken lines, FIG. 7 shows the pump 18 in a moved or flexed position. As shown, because of the flexibility of the arms 38, the pump is allowed to move slightly in either direction. The pump 18 is prevented from moving too far by the stops 42 which will come into contact with the upper portion of the arms 38 when the pump 18 is flexed a certain amount. In the preferred embodiment, if the pump deflects more that 0.150 inches, there is an interference between one of the arms 38 and the corresponding stop 42. In this way, the mount 32 allows the pump to be flexible, but at the same time restricts the motion of the pump 18.

In an alternative embodiment, the pump 18 has two feet each with a rubberized slider slid into place. The pump and rubberized sliders are set into the mounting apertures 46 as described above and rotated into position as described above. In this embodiment, the rubber isolators absorb the high frequency vibrations generated by the pump. In another embodiment, components other than hoses, such as wiring harness, could be used to hold the pump in the locked position. Note that other alternatives are also possible within the scope of the present invention. In addition, the present invention may apply to a variety of appliances including clothes washing machines, dish washing machines, dryers, refrigerators, etc.

The present invention operates as follows. The operation of the present invention will be described from the standpoint of the installation of the pump 18, or the service and maintenance of the pump 18. When the pump 18 is initially installed into the washing machine 10, the pump 18 is positioned above the base 20 with the feet 34 aligned with the first ends 48 of the mounting apertures 46 (shown by solid lines in FIG. 5). With the feet 34 inserted through the holes 46, the pump 18 is rotated counterclockwise to the position shown by dashed lines in FIG. 5. To lock the pump 18 into place, the hoses 52 and 54 are connected to the input and output ports 28 and 30, respectively.

When the pump needs replacing or servicing, a technician simply detaches hoses 52 and 54 and rotates the pump 18 clockwise to the position shown by solid lines in FIG. 5. The pump 18 can then be removed from the base 20. At no time does a technician need access to the bottom side of the base 20. In addition, the technician does not need to remove any screws or other fasteners.

If pressure is applied to the pump 18 during shipping or during use, the flexible pump mount 32 will allow the pump 18 to flex, reducing the chance of breakage. However, the pump mount 32 will prevent the pump 18 from moving too far by means of the arms 38 and stops 42.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An improved washing machine, comprising:

a base with a plurality of openings therein, each opening having a large diameter portion and a small diameter portion;

a pump having a plurality of feet adapted to extend through the openings in the base;

the pump being rotatable on the base between an unlocked position wherein the feet are aligned with the large diameter portions of the openings and a locked position wherein the feet are aligned with the small diameter portions of the openings; and a hose connected to the pump to allow the pump to function and to maintain the pump in the locked position.

2. The improved washing machine of claim 1 wherein the feet each have a diameter smaller than the large diameter portion of the opening and larger than the small diameter portion of the openings.

3. The improved washing machine of claim 1 wherein the pump and washing machine are free from mounting hardware extending beneath the base.

4. The improved washing machine of claim 1 wherein the pump includes a flexible mount between the pump and the feet to accommodate vibrations during operation of the pump.

5. An improved washing machine having a base and a pump, the improvement comprising:

a twist lock connection between the pump and the base; and a hose connected to the pump to prevent unlocking of the pump from the base and to allow functioning of the pump.

6. The improved washing machine of claim 5 wherein the twist lock connection includes at least one opening in the base with large and small diameter portions and a foot adapted to extend through the large diameter portion and move to the small diameter portion to lock the pump on the base.

7. The improved washing machine of claim 6 wherein the foot has a diameter smaller than the large diameter portion and larger than the small diameter portion.

8. The improved washing machine of claim 1 wherein the base is a part of a cabinet, and the pump is mounted within the cabinet.

9. An improved washing machine, comprising:

a base adapted to sit upon a floor, and with a plurality of openings therein, each opening having large and small diameter portions;

a pump having a bottom surface with a plurality of feet extending downwardly from the bottom surface, the feet being adapted to extend through the openings in the base for mounting the pump to the base;

the pump being rotatable on the base between an unlocked position wherein the feet are aligned with the large diameter portions of the openings and a locked position wherein the feet are aligned with the small diameter portions of the openings; and a hose connected to the pump to allow the pump to function and to maintain the pump in the locked position.

* * * * *